US005305820A

United States Patent [19]

Tsuru et al.

[11] Patent Number: 5,305,820

[45] Date of Patent: Apr. 26, 1994

[54] WITHDRAWAL CONTROL PROCESS OF HORIZONTAL CONTINUOUS CASTING

[75] Inventors: Masahiro Tsuru; Tatuo Saiki; Akihiro Nakajima, all of Tokyo, Japan

[73] Assignee: NKK Corporation, Tokyo, Japan

[21] Appl. No.: 910,274

[22] PCT Filed: Nov. 20, 1991

[86] PCT No.: PCT/JP91/01590

§ 371 Date: Jul. 17, 1992

§ 102(e) Date: Jul. 17, 1992

[87] PCT Pub. No.: WO92/09384

PCT Pub. Date: Jun. 11, 1992

[30] Foreign Application Priority Data

Nov. 21, 1990 [JP] Japan ..... 2-314155

[51] Int. Cl.[5] ..... B22D 11/04

[52] U.S. Cl. ..... 164/478; 164/490

[58] Field of Search ..... 164/484, 478, 490

[56] References Cited

FOREIGN PATENT DOCUMENTS

| | | | |
|---|---|---|---|
| 60-96357 | 5/1985 | Japan . | |
| 60-187453 | 9/1985 | Japan . | |
| 61-2459 | 1/1986 | Japan . | |
| 61-46364 | 3/1986 | Japan . | |
| 62-275554 | 11/1987 | Japan . | |
| 1-53746 | 3/1989 | Japan | 164/478 |

*Primary Examiner*—Kuang Y. Lin

*Attorney, Agent, or Firm*—Michael N. Meller

[57] ABSTRACT

A method of controlling drawing of a cast piece in horizontal continuous casting, in which drawing is controlled in accordance with an inwardly curved passage to keep the acceleration low at the start of the drawing and to increase it gradually in the drawing process for the purpose of reducing the number of bubbles appearing on the surface layer of the cast piece by sucking the ambient air into the mold when drawing the cast piece.

2 Claims, 2 Drawing Sheets

WITHDRAWAL CONTROL PROCESS OF HORIZONTAL CONTINUOUS CASTING

TECHNICAL FIELD

The present invention relates to a withdrawal process of horizontal continuous casting, and particularly relates to a withdrawal control process for controlling acceleration at the velocity-up stage in a pull step of pulling a cast matter.

BACKGROUND OF THE INVENTION

In horizontal continuous casting, a casting process in which a cast matter pulling cycle is composed of a pull step, a pause step and a push back step is known (Japanese Unexamined Patent Publication No. Sho-58-44950). FIG. 2 typically shows a pattern of the pulling velocity in the above steps.

In a horizontal continuous casting process for casting a cast matter having a cross sectional size of 80–350 mm at a high pulling velocity (not lower than 1.6 m/min), the pulling cycle is set to about 120 cycle/min, and time $t_o$ of one pulling cycle is set to about 0.5 sec. The respective times $t_1$, $t_2$ and $t_3$ of the pull, pause and push back steps are set to 0.2 sec, 0.1 sec and 0.2 sec respectively. In this case, the pulling velocity $V_c$ in the pull step rises abruptly following an almost linear speed gradient in about 0.04 sec. That is, a cast matter is pulled suddenly with an almost linear velocity gradient k ($=\tan\theta$) from a start point A to a point B. Then, the cast matter is pulled at a uniform speed from the point B to a point C, and the velocity is decreased suddenly from the point C to a point D. Then the pulling is paused from the point D to a point E, and next the cast matter is pushed in the reverse direction, that is, back to the mold slightly from the point E. Then, returning to the start point A through points E, G and H, one pulling cycle is finished.

In such a conventional withdrawal control process, there is a particular problem in that outside air enters into a mold in the velocity-up stage in the step of pulling a cast matter. This phenomenon causes residual bubbles 2 in a surface layer portion of a cast matter 1 as shown in FIG. 3, and if the number of residual bubbles increases, the bubbles appear as linear flaws in the surface of products at the time of rolling so that the quality deteriorated. The cause of such residual bubbles is that the pull velocity in the velocity-up stage is so high that negative pressure is produced in a portion called a triple point 5 between a mold 3 and a brake ring 4 to lead the outside air therein, the air being brought into molten metal to be trapped as bubbles surface layer portion of of shell solidifying thereon.

In order to solve the problem of residual bubbles in a surface layer portion of a cast matter, a device of preventing the outside air from entering into the above-mentioned triple point has been made (Japanese Unexamined Utility Model Publication No. Hei-1-30687). A seal mechanism disclosed in this application is constituted by three members, that is, a mold 3, a brake ring 4 and a feed tube 7 which are joined with each other with a flexible thin plate 8 (carbon sheet or the like) inserted as a gasket into a joint portion of the three members.

However, the gasket system is not always reliable and requires skilled workers and rather long fitting work time. Accordingly, the gasket system is not recommendable.

The present invention is intended to prevent the outside air from entering into a mold only through pulling acceleration control in the consideration of the foregoing disadvantage and inconvenience caused by employing such a mechanical seal mechanism, and it is an object of the present invention to provide a withdrawal control process of horizontal continuous casting in which the number of bubbles in a surface layer portion of a cast matter can be reduced extremely.

DISCLOSURE OF THE INVENTION

In order to attain the foregoing object, the withdrawal control process of horizontal continuous casting, according to the present invention, comprising a cast matter pulling cycle composed of a pull step, a pause step and a push back step, is characterized in that acceleration in the pull step is controlled at a specified value of acceleration and, preferably, is controlled along an inwardly curved trace of pull velocity in the pull acceleration beginning stage so that the value of acceleration is made small at the start and then made it large in the succeeding beginning part of acceleration. That is, the pulling velocity pattern is made to be an inward curved shape from a point A to a point B. Specially, the acceleration of the initial stage of pull is reduced to maximum 0.4~0.6 m/sec$^2$ which is about a quarter of conventional acceleration, in a period of withdrawal about of 2 mm.

After the point A, the phenomenon of negative pressure in the mold is less probable, because the region between the moving shell of cast matter and the triple point has been filled with the molten metal to seal the clearance on the triple point. The value of acceleration may then be further safely from 0.6 cm/sec$^2$ along an inwardly curved pull velocity trace.

As has been described above, according to the present invention, the acceleration in the pull step is controlled along a curved trace so that the value of acceleration is made small at an acceleration beginning stage and made large succeedingly. Accordingly, no phenomenon of negative pressure is produced, so that it is possible to prevent the outside air from entering into a mold and it is possible to reduce the number of produced bubbles in a surface layer portion of a cast matter extremely. It is therefore unnecessary to provide any mechanical seal mechanism to make it possible to eliminate the disadvantage and inconvenience due to the provision of the seal mechanism. Accordingly, the above-mentioned effect can be obtained only by controlling the acceleration in the velocity-up stage.

In addition, according to the present invention, it was possible to obtain an improved cast matter of Ca-S free cutting steel stably.

DESCRIPTION OF THE INVENTION

Figure 1:
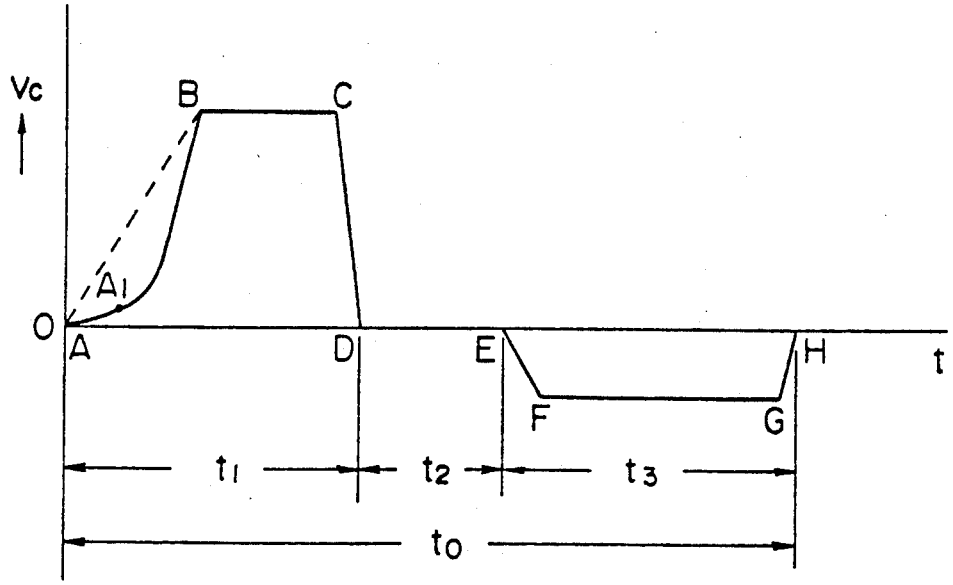
FIG. 1 shows schematically a non-limited explanatory diagram illustrating the configuration of a pulling velocity pattern according to the present invention.
Figure 2:
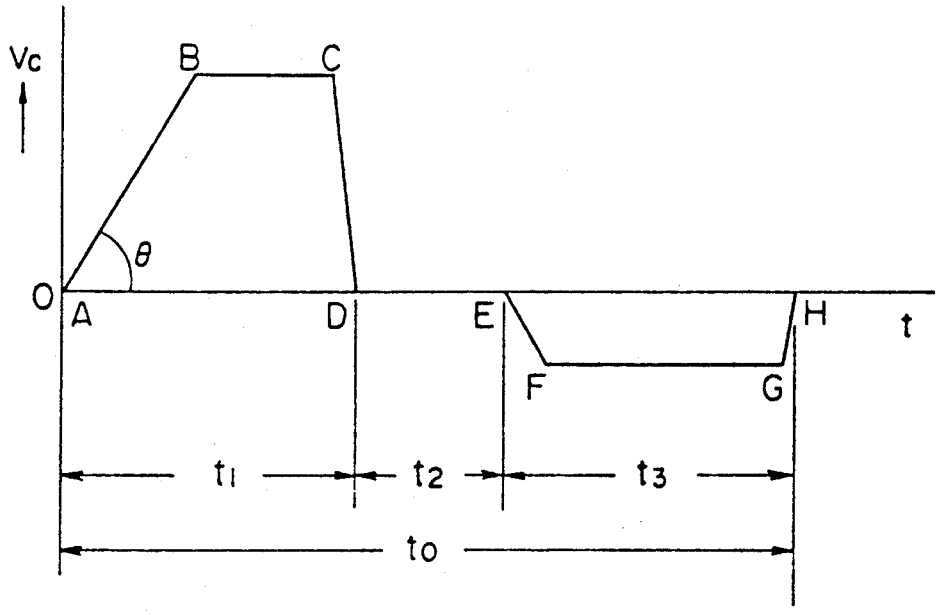
FIG. 2 PRIOR ART
FIG. 2 is a typical diagram illustrating a conventional pulling velocity pattern.

FIG. 1 is a typical diagram illustrating a pulling velocity pattern according to the present invention. That is, although the acceleration in the pulling velocity-up stage in the pull step is always kept constant as shown by a dotted line in FIG. 1 according to the conventional method, the acceleration according to the present invention is divided into two stages so that control is made so as to make the acceleration small at the start and then make it large in the succeeding beginning part of acceleration along an inwardly curved trace of pull velocity in the pull acceleration beginning stage. The pulling velocity pattern is the same as in the conventional case, except that it is different from the conventional case in its region of from the point A to the point B. In practice, the acceleration from the point A to the point $B_1$ is made 0.4~0.6 m/sec$^2$ i.e., as illustrated in FIG. 1 the value of the acceleration at point A, has a maximum value of 0.4 m/sec$^2$ and then increases from point A to point B, to a maximum value of 0.6 m/sec$^2$ up to point B following an inwardly curved pull velocity trace along the beginning part of the acceleration stage which may be further increased, if required, to achieve a targeted amount of pull length.

Figure 3:
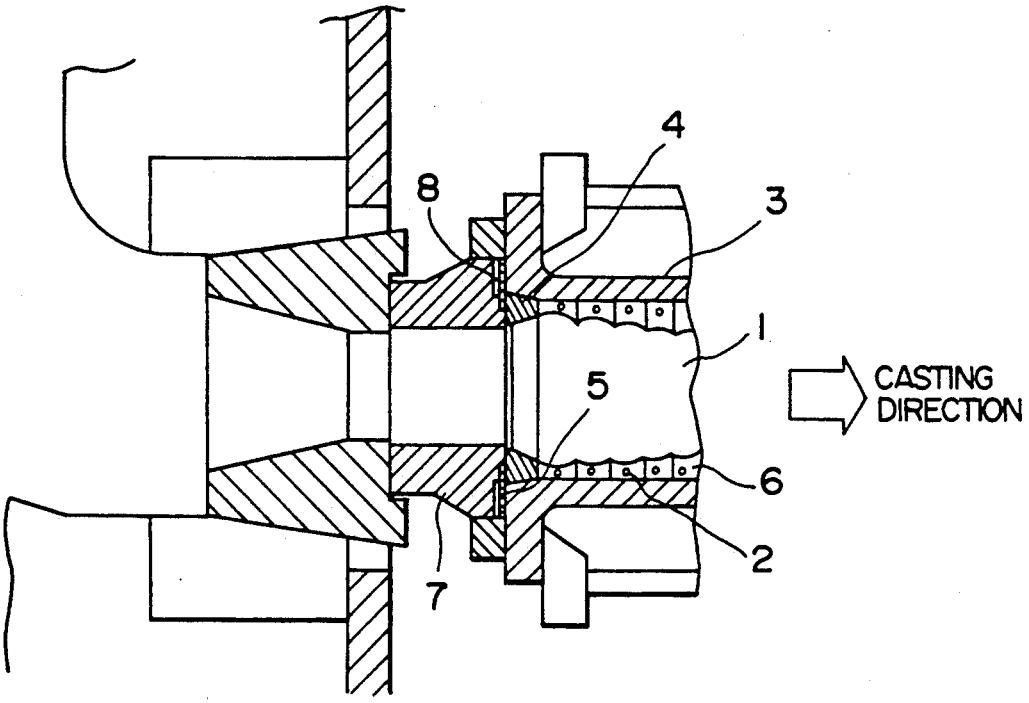
FIG. 3 PRIOR ART
FIG. 3 is a configuration diagram illustrating a conventional mold device, or an explanatory diagram showing a state of residue of bubbles in a surface layer portion of a cast matter.

The mean value of acceleration from point A to point B, is, however, maintained at a maximum value 0.6 m/sec$^2$. Since the acceleration was made 1.6 m/sec$^2$ in the conventional case, the acceleration is reduced into about a quarter thereof. In the period of the initial pulled quantity of about 2 mm (since the pulling stroke varies according to the size of a cast cast matter, it is easier to perform control over the pulling velocity-up stage in the pull step based on the pulling quantity than based on time), no phenomenon of negative pressure shown in FIG. 3 is produced at the triple point 5 because the withdrawal is made with a low velocity. If this pulling velocity is made too low, the solidification of a shell is so progressed that a cast matter cannot be pulled. The pulling quanitity is detected by using withdrawal length measuring system linked with a withdrawal control computer (not shown) or the like provided in the casterline of the down stream of a mold.

After the point A, the phenomenon of negative pressure in the mold is less probable because the region between the moving shell of cast matter and the triple point 5 has been filled with molten metal to seal the clearance on the triple point 5. The value of acceleration may then be increased safely to a maximum of 0.6 m/sec$^2$ along an inwardly curved pull velocity trace.

As has been described above, since no phenomenon of negative pressure is produced at the triple point, it is possible to prevent the outside air from entering into a mold even if no conventional seal mechanism is provided, and it is possible to reduce bubbles in a surface layer portion of a cast matter. If the process according to the present invention is used in addition to the provision of a seal mechanism, needless to say, a more advantageous effect can be obtained.

The results of horizontal continuous casting according to the present invention and the conventional process with respect to Ca-S free cutting steels was obtained as follows.

Cast Matter Size: $\phi$ 120 mm
Pulling Cycle: 120 cpm
Casting Speed: 1.6 m/min
Melted Steel Superheat Temperature (in Tundish): 20° C.
Melted Steel Composition (%):

| C | Si | Mn | P | S | Al | Cr | Ca |
|---|---|---|---|---|---|---|---|
| 0.33 | 0.24 | 0.76 | 0.008 | 0.058 | 0.007 | 0.03 | 0.0095 |

Figure 4:
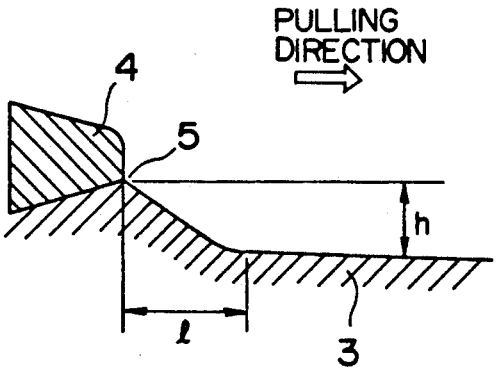
FIG. 4 is an explanatory diagram of a mold showing the quantity of projection of a triple point.

Mold: quantity of projection of triple point h = 4.0 mm, l = 8.0 mm (see FIG. 4)
Pulling Acceleration: process of present invention 0.4 m/sec$^2$; conventional process 1.6 m/sec$^2$
Seal Mechanism: not provided in the both the processes After horizontal casting was performed under the above conditions, the number of produced bubbles in 3 mm-depth portion under a surface layer of a cast matter at each of a bottom portion thereof (portion at the beginning of withdrawal), a middle portion thereof (intermediate portion), and a top portion thereof (portion at the termination of withdrawal) was examined.

The results are shown in Table 1.

TABLE 1

| | Bottom portion | Middle portion | Top portion |
|---|---|---|---|
| Conventional Process | 392 | 722 | 397 |
| Process of the Invention | 32 | 9 | 0 |

As understood from the results, the number of produced bubbles was reduced extremely in the process according to the present invention.

In addition, the distribution of Ca in cross section was uniform.

What is claimed is:

1. A withdrawal control process of horizontal continuous casting comprising a cast matter pulling cycle composed of a pull step, a pause step and a push back step, characterized in that the pull step is controlled along an inwardly curved pulling velocity trace in the pull acceleration beginning stage and that the value of acceleration of said cast matter pulling velocity at the beginning part of the acceleration stage in the pull step is not larger than 0.6 m/sec$^2$.

2. A withdrawal control process of horizontal continuous casting according to claim 1, characterized in that the mean value of acceleration of said cast matter pulling velocity along said inwardly curved pulling velocity trace is not larger than 0.6 m/sec$^2$.

* * * * *